United States Patent [19]

Olsen

[11] Patent Number: 4,493,519

[45] Date of Patent: Jan. 15, 1985

[54] ADAPTER PLUG FOR CURRENT SUPPLY RAIL SYSTEMS

[76] Inventor: Kolbjørn Olsen, Trondenes, 9400 Harstad, Norway

[21] Appl. No.: 943,226

[22] Filed: Sep. 18, 1978

[30] Foreign Application Priority Data

Sep. 30, 1977 [NO] Norway ..... 773349

[51] Int. Cl.[3] ..... H01R 13/625; H01R 13/629

[52] U.S. Cl. ..... 339/75 M; 339/22 B; 339/88 R

[58] Field of Search ..... 339/21 R, 22 R, 22 B, 339/75 M, 88 R

[56] References Cited

U.S. PATENT DOCUMENTS

| | | | |
|---|---|---|---|
| 3,646,501 | 2/1972 | Valtowen | 339/75 M |
| 3,718,816 | 2/1973 | Seelbach et al. | 339/22 B X |
| 3,718,886 | 2/1973 | Hoffmeister | 339/21 R |

*Primary Examiner*—Eugene F. Desmond

[57] ABSTRACT

Adapter for connection to electric current carrying rails having movable contacts for the electric connection and mechanical locking means including a button operated release mechanism to prevent incorrect insertion of the adapter in the rail.

6 Claims, 5 Drawing Figures

ADAPTER PLUG FOR CURRENT SUPPLY RAIL SYSTEMS

The present invention pertains to an adapter plug for electric current supply rail systems for lighting purposes. Current-conducting rails, or lighting supply rails, are used to an increasing extent in department stores, display windows, industrial halls and in other places where it is advantageous to be able to take out electric current as close to the place where the current is to be used as possible. The rails can be made of extruded aluminum containing electrical conductors which are insulated from the rest of the rail, and the adapter plugs that couple to the rail have retractable-extensible contacts which, after the adapter has been correctly positioned in the rail, can be brought into contact with the current-conducting conductors in the rail by turning an operating knob. Simultaneously, this operation also results in the securing of the adapter to the rail. The adapter can be connected to a wire that leads to the site where the current is to be used, or the adapters themselves can directly support spotlights or other fittings which can then be moved as needed or desired.

When three-phase RST is used, one can also, as desired, connect or disconnect those portions of the lighting that are needed at any one time.

Several different current supply rail systems are previously known. Each of the rails has a different cross-sectional configuration; and there utilizes an adapter plug having a corresponding configuration; this results in the disadvantage that an adapter made for one rail system cannot be used in another rail system.

The purpose of the present invention is to arrive at an adapter plug design which will permit the adapter to be used on at least two main types of current-conducting rails or supply rails having different cross-sectional configurations.

In accordance with the invention, this is achieved in that the adapter plug has a longitudinal rib and a release button for the operating mechanism disposed on the respective opposing sides of the contact-bearing portion of the adapter plug. This makes it possible to utilize different structural details on the respective supply rail systems as interfaces for the adapter when it is inserted into one or the other current rail. In addition, the adapter is not only able to be inserted and fixedly attached to the rail, but its orientation when installed should be such that the phases RST will be correctly coupled to their respective contacts on the adapter, even though the sequence of the three phases can vary from rail to rail. This problem is also solved by the present invention.

Figure 1:
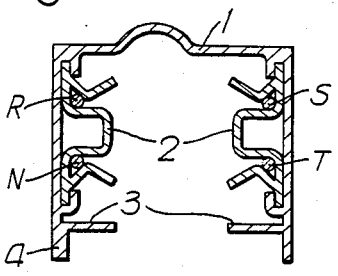
Figure 2:
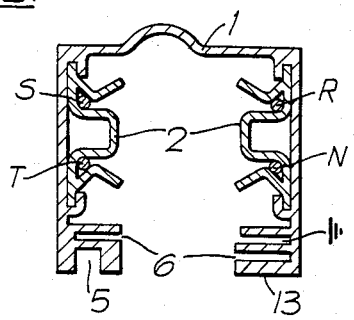
Figure 3:
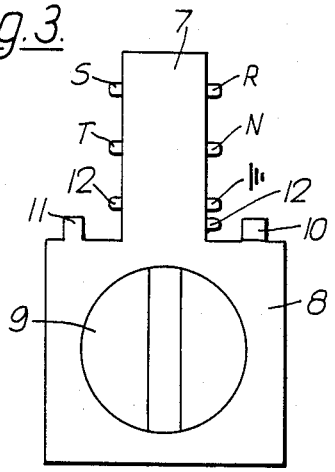
Figure 4:
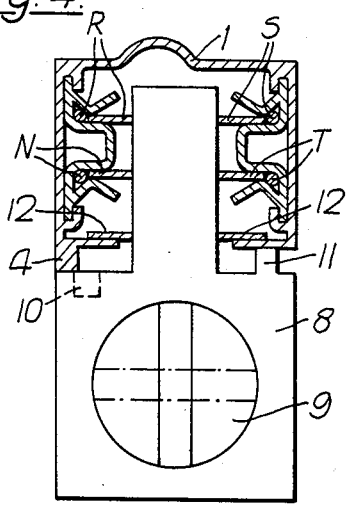
Figure 5:
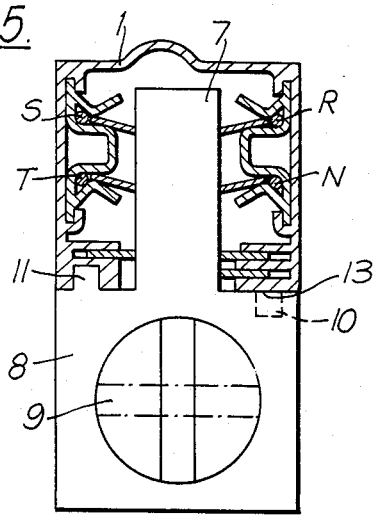

The invention is characterized by the features disclosed in the appurtenant patent claims, and will be elucidated in greater detail in the following with reference to the drawings, where FIGS. 1 and 2 illustrate two different main types of current-conducting rails, FIG. 3 shows an adapter plug made in accordance with the invention, and FIGS. 4 and 5 show the adapter plug connected up to the rails of FIGS. 1 and 2, respectively.

The current-conducting rail shown on FIG. 1 comprises an aluminum extrusion 1, with four conductors for three phases and a neutral conductor, RST and N, attached to the interior of the U-shaped rail 1, the conductors being insulated from the aluminum rail by insulating material 2. The aluminum extrusion also comprises locking surfaces 3 and a guide edge 4. This cross-sectional configuration for a current-conducting rail or supply rail is well known and should not require further description. FIG. 2 shows a second embodiment of a supply rail, also having four conductors for the phases RST and a neutral conductor N disposed within and insulated from the aluminum extrusion 1. It should be noted that the sequence of the phases in FIG. 2 is the opposite of that in the rail of FIG. 1. The rail of FIG. 2 also has a guide groove 5 and a locking groove 6. The ground connections for the two rails are also different.

FIG. 3 shows an embodiment of an adapter plug in accordance with the invention. Disposed on the contact-bearing portion 7 of the adapter 8 are contacts RSTN and a ground wire contact. These contacts can be moved out from the contact-bearing portion 7 by turning an operating knob 9. This knob is inoperative, however, unless a button 10 has been depressed. This button will be depressed only when the adapter has been correctly positioned in the supply rails, and only then can the knob be operated and movement of the contacts RST and N initiated. The button 10 is located on one side of the contact-bearing portion 7, and on the other side is a rib 11 which can either be one coherent structure or made as a series of control buttons. As known per se, the adapter 8 on FIG. 3 also has securing means 12, which also are operated by the knob 9 and which serve to lock the adapter into the supply rail. The contacts RSTN are resiliently movable upwards and downwards, as disclosed in another patent belonging to the same patentee.

The method of operation for the invention can be seen more clearly from FIGS. 4 and 5. If the adapter 8 on FIG. 3 is to be used on the supply rail of FIG. 1, the contact-bearing portion 7 is guided up into the rail, and it can be seen that in order to get the correct phases coupled to the correct contacts on the adapter 8, the adapter of FIG. 3 must be turned around. As this is done, the button 10 will come beneath the guide edge 4 and be pushed down by it. When the button 10 has been depressed, the operating member 9 will become connected to the operating mechanism, and by turning the knob 9, the contacts RST and N will move out into contact with the corresponding conductors for the phases RST and the neutral conductor N in the rail. Simultaneously, the securing means 12 will lock the adapter 8 into the rail 1, because the securing means will have come behind the locking surface 3. The longitudinal rib 11 abuts against the underside of the rail, so that the adapter is stabilized. It can also be seen that if one should try to insert the adapter the wrong way, i.e., with the rib 11 coincident with the guide edge 4, the button 10 would not be depressed and thus the operating mechanism would not function, because the knob 9 would either be blocked or disconnected, depending on the way in which the adapter has been made.

If the adapter 8 is to be used on the rail shown on FIG. 2, the same requirement, that the respective conductors and contacts for the phases coincide, naturally still applies. The adapter can then be in the position shown on FIG. 3, and the contact-bearing portion 7 inserted into the rail. The rib 11 will then fit into the guide groove 5, and the button 10 will be depressed via its contact against the underside 13 of the rail. This in turn means that the operating mechanism can be activated by turning the knob 9 to the position shown with broken lines on FIG. 5. The fact that the conductors RSTN in the two rails are at different heights is not important, because the contacts on the adapter plug, as mentioned previously, have a spring-like resilience upwards and downwards, in accordance with another invention, which permits them to seek their way in to the conductors, as seen on FIG. 5. At the same time, the securing means 12, in the same way as explained above, will lock the adapter 8 into the rail 1. In the rail shown on FIG. 5, this securing will also establish the ground connection while on FIG. 4 one could for example have an automatic ground connection between the adapter and the bottom of the rail in a manner which is known per se and which will thus not be described further in this specification.

In addition to the features and details described above, for some types of rails it is preferable that the rib and release button on the adapter plug be equidistant from a central plane through the contact-bearing portion, as release could otherwise occur when the adapter was incorrectly inserted in said rail types.

The embodiment illustrated in this specification serves only to illustrate the invention and should not be construed as limiting the scope of protection provided by this patent, as other embodiments could easily be imagined for an adapter plug which is to be fitted to more than one supply rail or current-conducting rail.

Having described my invention, I claim:

1. An adapter plug for connection to at least two current supply rails having different types of interfacing for adapter plugs, and capable of being operatively connected with each of the current supply rails in only one predetermined position to supply electrical current to an electrically powered device, comprising:

a base member;

a contact-bearing portion attached to said base member and adapted to be inserted into a current supply rail;

a plurality of movable contacts disposed on said contact bearing portion;

means for moving said movable contacts into operative engagement with a current supply rail when said contact-bearing portion is fully inserted into the current supply rail;

a release button for rendering said moving means operative to move said movable contacts when the contact-bearing portion is inserted into a current supply rail in a predetermined position, said release button being mounted on said base member adjacent one side of said contact-bearing member and adapted to engage an underside surface of the current supply rail and be depressed thereby when said contact-bearing portion is inserted into the current supply rail in the predetermined position to thereby render said moving means operative; and a guide rib mounted on said base member adjacent a side of said contact-bearing portion opposite said one side, for stabilizing the adapter plug when said contact-bearing portion is inserted into the current supply rail in the predetermined position and for abutting the underside surface of the current supply rail when the contact-bearing portion is inserted into the current supply rail in a position other than the predetermined position to inhibit the contact-bearing portion from being fully inserted into the current supply rail and thereby provide a readily discernible signal that the adapter plug is not in the predetermined position.

2. The adaptor plug means according to claim 1 in which the rib is one coherent piece.

3. The adaptor plug means according to claim 1 in which the rib is formed of at least two separate parts.

4. The adaptor plug means according to claim 1 in which the separate parts are fixed studs.

5. The adaptor plug means according to claim 1 in which an outwardly facing side of the guide rib and an outwardly facing side of the release button are equidistant from a central plane through the contact-bearing portion.

6. An adaptor plug for connecting electrically powered devices to at least two different types of current supply rails, comprising:

a contact bearing portion having contact means which are movable and engage at least one current-carrying conductor inside a current supply rail;

release button means, disposed on a surface of the adaptor plug, to unlock said contact means when said release button means is depressed upon a correct connection with said current supply rail;

a guide rib disposed on said surface of the adaptor plug such that an outwardly facing side of said guide rib and an outwardly facing side of said release button means are equidistant from a central plane through said contact bearing portion.

* * * * *